US006286796B1

(12) United States Patent
Pugliesi

(10) Patent No.: US 6,286,796 B1
(45) Date of Patent: Sep. 11, 2001

(54) VIDEO CAMERA MOUNTING APPARATUS

(76) Inventor: Andy J. Pugliesi, Box #51, Webster, PA (US) 15087

( * ) Notice: Subject to any disclaimer, the term of this patent is extended or adjusted under 35 U.S.C. 154(b) by 0 days.

(21) Appl. No.: 09/473,088

(22) Filed: Dec. 28, 1999

(51) Int. Cl.[7] ..... F41B 5/14

(52) U.S. Cl. ..... 248/187.1; 124/88; 396/428; 248/231.9

(58) Field of Search ..... 396/419, 428; 108/158, 147.17, 149, 157.1; 124/86, 88; 248/220.22, 222.14, 187.1, 230.8, 231.9, 221.11; 182/92, 187; 411/389, 388

(56) References Cited

U.S. PATENT DOCUMENTS

| | | | | |
|---|---|---|---|---|
| D. 367,284 | | 2/1996 | Hoerter | D16/242 |
| 1,459,404 | * | 6/1923 | Kleffman | 248/220.21 |
| 2,755,053 | * | 7/1956 | Sloane | 248/179.1 |
| 3,062,114 | | 11/1962 | Palos | 352/131 |
| 3,563,131 | * | 2/1971 | Ridley, Sr. | 411/384 |
| 4,296,725 | | 10/1981 | Broderick | 124/23.1 |
| 4,327,888 | * | 5/1982 | Scheneman | 248/220.43 |
| 5,064,109 | | 11/1991 | Caster | 224/267 |
| 5,528,325 | * | 6/1996 | Perez | 396/155 |
| 5,611,324 | | 3/1997 | Kursinsky | 124/86 |
| 5,790,910 | | 8/1998 | Haskin | 396/427 |

* cited by examiner

*Primary Examiner*—Ramon O. Ramirez
*Assistant Examiner*—Jon A Szumny

(57) ABSTRACT

A video camera mounting apparatus for mounting to a bow. The video camera mounting apparatus is mountable in the stabilizer mounting hole of a bow. The apparatus comprises a camera support for supporting the video camera thereon. The camera support comprises a first plate and a second plate. The second plate is fixedly coupled to an edge of the first plate. A camera support mounting apparatus for mounting the camera support to the bow comprises a bore in the second plate, and a securing means for releasably securing the second plate to the bore. The securing means is inserted through the bore in the second plate and into the stabilizer mounting hole.

13 Claims, 2 Drawing Sheets

FIG 1
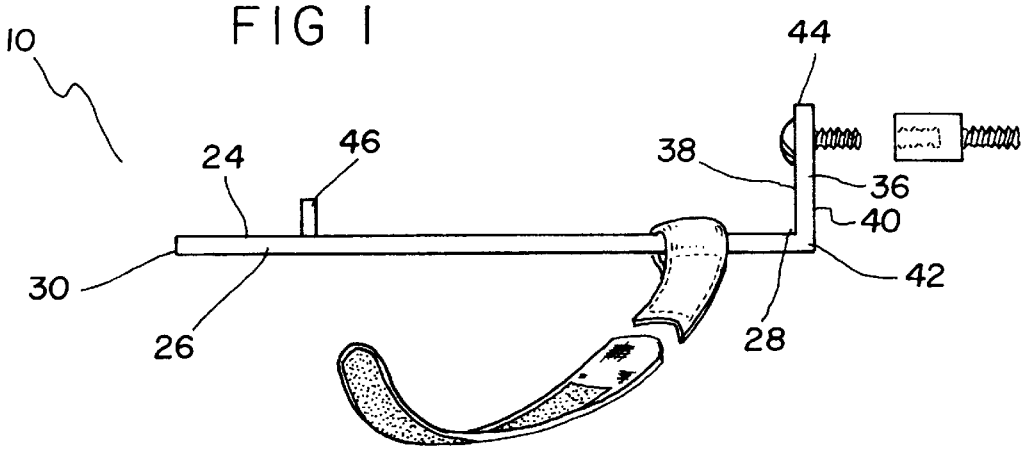
FIG 2
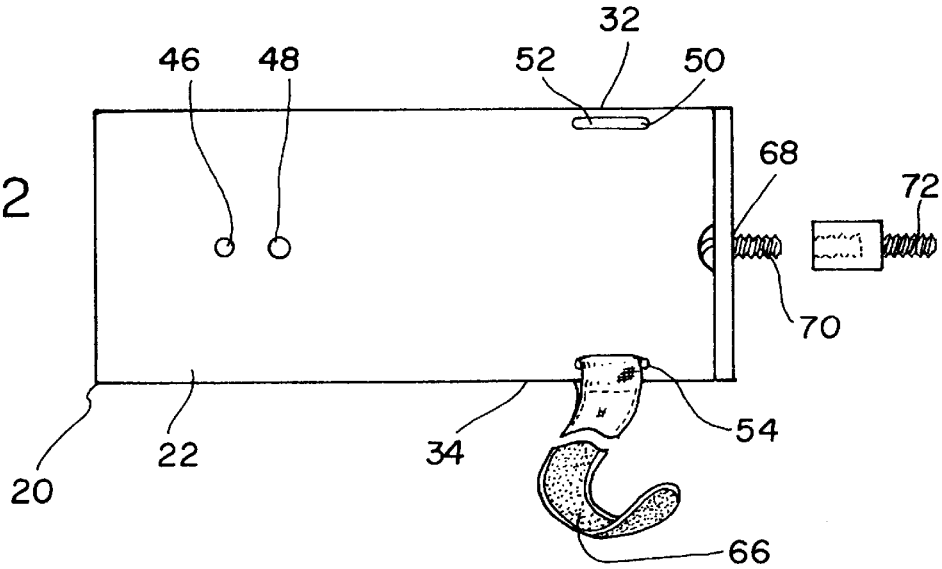
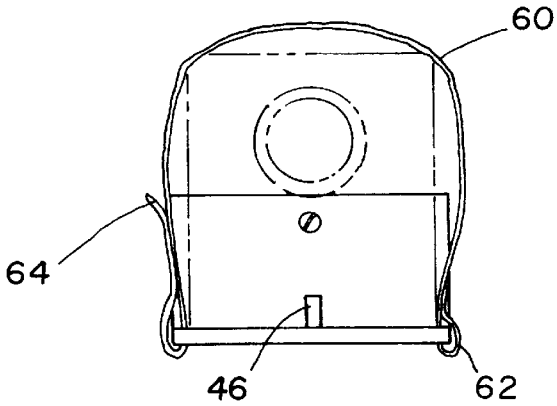
FIG 3

VIDEO CAMERA MOUNTING APPARATUS

BACKGROUND OF THE INVENTION

1. Field of the Invention

The present invention relates to video camera mountings and more particularly pertains to a new video camera mounting apparatus for mounting to a bow.

2. Description of the Prior Art

The use of video camera mountings is known in the prior art. More specifically, video camera mountings heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,296,725; U.S. Pat. No. 5,611,324; U.S. Pat. No. 5,90,910; U.S. Pat. No. 5,064,109; U.S. Pat. No. 3,062,114; and U.S. Pat. No. 367,284.

While these devices fulfill their respective, particular objectives and requirements, the aforementioned patents do not disclose a new video camera mounting apparatus. The inventive apparatus is mountable in the stabilizer mounting hole of a bow. The apparatus comprises a camera support for supporting the video camera thereon. The camera support comprises a first plate and a second plate. The second plate is fixedly coupled to an edge of the first plate. A camera support mounting apparatus for mounting the camera support to the bow comprises a bore in the second plate, and a securing means for releasably securing the second plate to the bore. The securing means is inserted through the bore in the second plate and into the stabilizer mounting hole.

In these respects, the video camera mounting apparatus according to the present invention substantially departs from the conventional concepts and designs of the prior art, and in so doing provides an apparatus primarily developed for the purpose of mounting to a bow.

SUMMARY OF THE INVENTION

In view of the foregoing disadvantages inherent in the known types of video camera mountings now present in the prior art, the present invention provides a new video camera mounting apparatus construction wherein the same can be utilized for mounting to a bow.

The general purpose of the present invention, which will be described subsequently in greater detail, is to provide a new video camera mounting apparatus apparatus and method which has many of the advantages of the video camera mountings mentioned heretofore and many novel features that result in a new video camera mounting apparatus which is not anticipated, rendered obvious, suggested, or even implied by any of the prior art video camera mountings, either alone or in any combination thereof.

To attain this, the present invention generally comprises an apparatus mountable in the stabilizer mounting hole of a bow. The apparatus comprises a camera support for supporting the video camera thereon. The camera support comprises a first plate and a second plate. The second plate is fixedly coupled to an edge of the first plate. A camera support mounting apparatus for mounting the camera support to the bow comprises a bore in the second plate, and a securing means for releasably securing the second plate to the bore. The securing means is inserted through the bore in the second plate and into the stabilizer mounting hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new video camera mounting apparatus apparatus and method which has many of the advantages of the video camera mountings mentioned heretofore and many novel features that result in a new video camera mounting apparatus which is not anticipated, rendered obvious, suggested, or even implied by any of the prior art video camera mountings, either alone or in any combination thereof.

It is another object of the present invention to provide a new video camera mounting apparatus which may be easily and efficiently manufactured and marketed.

It is a further object of the present invention to provide a new video camera mounting apparatus which is of a durable and reliable construction.

An even further object of the present invention is to provide a new video camera mounting apparatus which is susceptible of a low cost of manufacture with regard to both materials and labor, and which accordingly is then susceptible of low prices of sale to the consuming public, thereby making such video camera mounting apparatus economically available to the buying public.

Still yet another object of the present invention is to provide a new video camera mounting apparatus which provides in the apparatuses and methods of the prior art some of the advantages thereof, while simultaneously overcoming some of the disadvantages normally associated therewith.

Still another object of the present invention is to provide a new video camera mounting apparatus for mounting to a bow.

Yet another object of the present invention is to provide a new video camera mounting apparatus which includes an apparatus mountable in the stabilizer mounting hole of a bow. The apparatus comprises a camera support for supporting the video camera thereon. The camera support comprises a first plate and a second plate. The second plate is fixedly coupled to an edge of the first plate. A camera support mounting apparatus for mounting the camera support to the bow comprises a bore in the second plate, and a securing means for releasably securing the second plate to the bore. The securing means is inserted through the bore in the second plate and into the stabilizer mounting hole.

Still yet another object of the present invention is to provide a new video camera mounting apparatus that holds a video camera such that the video camera records images along a plane parallel to the aim of the user of the bow.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side view of a new video camera mounting apparatus according to the present invention.

FIG. 2 is a schematic plan view of the present invention.

FIG. 3 is a schematic front view of the present invention.

DESCRIPTION OF THE PREFERRED EMBODIMENT

Figure 4:
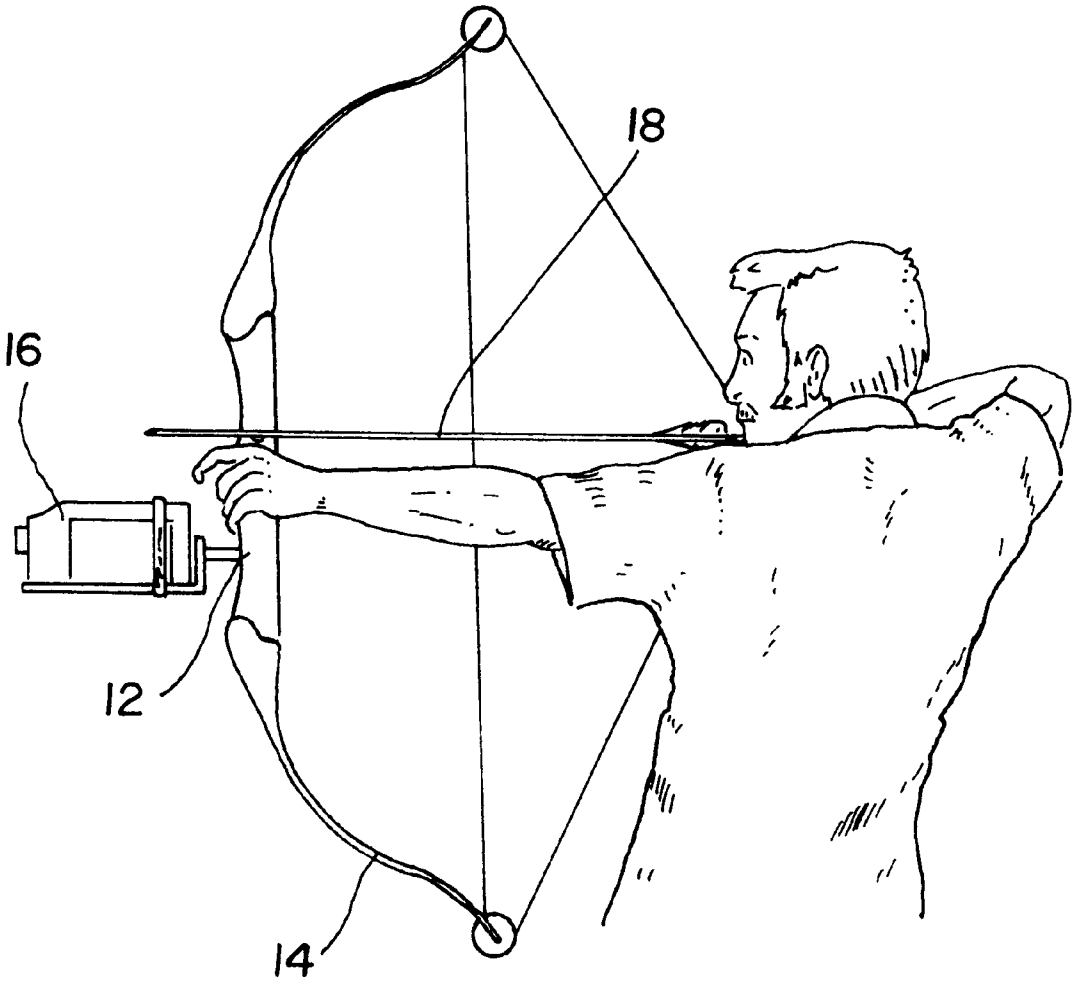
FIG. 4 is a schematic side view of the present invention.

With reference now to the drawings, and in particular to FIGS. 1 through 4 thereof, a new video camera mounting apparatus embodying the principles and concepts of the present invention and generally designated by the reference numeral 10 will be described.

As best illustrated in FIGS. 1 through 4, the video camera mounting apparatus 10 generally comprises device for holding a camera in the stabilizer mounting hole 12 a bow 14.

A camera support 20 supports the video camera 16 thereon. The camera support 20 comprises a first plate 22. The first plate 22 has a top surface 24. a bottom surface 26, a first edge 28, a second edge 30, a third edge 32 and a fourth edge 34, the first 28 and second 30 edges are opposite edges. The first plate 20 has a generally rectangular shape.

The camera support also comprises a second plate 36. The second plate 36 has a front surface 38, a back surface 40, a first edge 42 and a second edge 44. The first 42 and second 44 edges are opposite edges. The first edge 42 of the second plate 36 is integrally coupled to the first edge 28 of the first plate 22 such that the front surface 38 faces the first plate 22. The first 22 and second 36 plates have planes oriented generally perpendicular to each other. The second plate 36 has a generally rectangular shape.

A camera securing apparatus for securing the camera to the camera support 20 comprises an upstanding member 46, a bore 48 in the first plate, a fastening means, not shown, a pair of slots 50 and a strap 60.

The upstanding member 46 prevents movement of the video camera 16 with respect to the camera support 20. The upstanding member 46 is fixedly coupled to the top surface 24 of the first plate 22. The upstanding member 46 is generally located along a longitudinal axis bisecting the first 28 and second 30 edges of the first plate. The upstanding member 46 is located generally nearer the first edge 28 than the second 30 edge of the first plate 22. The upstanding member 46 forms a post having a generally cylindrical shape.

The bore 48 in the first plate 22 is located generally adjacent to the upstanding member 46. The bore 48 generally located along the longitudinal axis of the first plate 22.

A fastening means releasably fastens the video camera 16 to the first plate. The fastening means extends through the bore 48 in the first plate 22 and into a bottom portion of the video camera 16. The fastening means is a screw.

The pair of slots 50 is in the first plate 22. Each of the slots has a longitudinal axis oriented generally parallel with the longitudinal axis of the first plate 22. One of the slots 52 is located generally adjacent to the first 28 and third edges 32 of the first plate 22. One of the slots 54 is located generally adjacent to the first 28 and fourth 34 edges of the first plate.

The strap 60 removably holds the video camera 16 against the first plate 22. The strap 60 has a first end 62 and a second end 64. The first end 62 of the strap 60 is fixedly coupled in and about one of the slots 50. The second end 64 of the strap 60 has a fastening means 66 thereon such that the second end 64 of the strap 60 may be run through the other of the slots 50 and fastened to itself. The fastening means 66 on the second end of the strap is a hook and loop fastening means.

A camera support mounting apparatus mounts the camera support 20 to the bow 14 comprises a bore 68 in the second plate and a securing means.

The bore 68 in the second plate 36 is generally located adjacent to the second edge 44 of the second plate. The bore 68 is located generally along a longitudinal axis of the second plate intersecting the first 42 and second 44 edges of the second plate.

The securing means releasably secures the second plate 36 to the bow 14. The securing means is inserted through the bore 68 in the second plate 36 and into the stabilizer mounting hole 12. The securing means is a screw 70 and an extension screw 72. The screw 70 is insertable in the bore 68 in the second plate 26 and into an end of the extension screw 72. The extension screw 72 is insertable into the stabilizer mounting hole 12.

In use, the second plate 36 is releasably secured to the stabilizer mounting hole 12 using the securing means. The camera 16 is place on the first plate 22. The camera 16 is turned on and takes a video recording of the arrow 18 as it is shot from the bow 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A video camera mounting apparatus, the apparatus being mountable in a stabilizer mounting hole of a bow, said apparatus comprising:

a camera support for supporting a video camera thereon, said camera support comprising a first plate, said first plate having a top surface, a bottom surface, a first edge, a second edge, a third edge and a fourth edge, said first and second edges being opposite edges;

said camera support comprising a second plate, said second plate being fixedly coupled to an edge of said first plate, said second plate having a front surface, a back surface, a first edge and a second edge, said first and second edges being opposite edges, said first edge of said second plate being integrally coupled to said first edge of said first plate such that said front surface faces said first plate, said first and second plate having planes oriented generally perpendicular to each other;

a camera support mounting apparatus for mounting the camera support to said bow comprising:

a bore in said second plate; and a securing means for releasably securing said second plate to said bow, said securing means being inserted through said bore in said second plate for coupling to the stabilizer mounting hole; and a camera securing apparatus adapted for securing the camera to the camera support comprising:

an upstanding member for preventing movement of the video camera with respect to said camera support, said upstanding member being fixedly coupled to said top surface of said first plate.

2. The video camera mounting apparatus as in claim 1, wherein said upstanding member is generally located along a longitudinal axis bisecting said first and second edges of said first plate, said upstanding member being located generally nearer said first edge than said second edge of said first plate.

3. The video camera mounting apparatus as in claim 1, wherein said camera securing apparatus further comprises:

a bore in said first plate; and a fastening means for releasably fastening the video camera to said first plate, said fastening means extending through said bore in said first plate for coupling to a bottom portion of the video camera.

4. The video camera mounting apparatus as in claim 1, wherein said camera securing apparatus further comprises:

a pair of slots, each of said slots being in said first plate, one of said slots being located generally adjacent to one of said first and third edges of said plate, one of said slots being located generally adjacent to said first and fourth edges of said plate;

a strap for removably holding the video camera against said first plate, said strap having a first end and a second end, said first end of said strap being fixedly coupled in and about one of said slots, said second end of said strap having a fastening means thereon such that said second end of said strap may be run through the other of said slots and fastened to itself.

5. The video camera mounting apparatus as in claim 1, wherein said bore in said second plate is generally located adjacent to said second edge of said second plate, said bore being located generally along a longitudinal axis of said second plate intersecting said first and second edges of said second plate.

6. The video camera mounting apparatus as in claim 1, wherein said securing means of said camera mounting support apparatus comprises a screw and an extension screw, wherein said screw is insertable in said bore in said second plate and into an end of said extension screw, said extension screw being insertable into the stabilizer mounting hole.

7. A video camera mounting apparatus for mounting to a stabilizer mounting hole of a bow, said apparatus comprising:

a camera support for supporting a video camera thereon, said camera support comprising a first plate, said first plate having a top surface, a bottom surface, a first edge, a second edge, a third edge and a fourth edge, said first and second edges being opposite edges;

said camera support comprising a second plate, said second plate being fixedly coupled to an edge of said first plate, said second plate having a front surface, a back surface, a first edge and a second edge, said first and second edges being opposite edges, said first edge of said second plate being integrally coupled to said first edge of said first plate such that said front surface faces said first plate, said first and second plate having planes oriented generally perpendicular to each other;

a camera support mounting apparatus for mounting the camera support to said bow comprising:

a bore in said second plate; and a securing means for releasably securing said second plate to said bow, said securing means being inserted through said bore in said second plate for coupling to the stabilizer mounting hole; and a camera securing apparatus adapted for securing the camera to the camera support comprising:

a bore in said first plate; and a fastening means for releasably fastening the video camera to said first plate, said fastening means extending through said bore in said first plate for coupling to a bottom portion of the video camera.

8. The video camera mounting apparatus as in claim 7, wherein said camera securing apparatus further comprises:

a pair of slots, each of said slots being in said first plate, one of said slots being located generally adjacent to one of said first and third edges of said plate, one of said slots being located generally adjacent to said first and fourth edges of said plate;

a strap for removably holding the video camera against said first plate, said strap having a first end and a second end, said first end of said strap being fixedly coupled in and about one of said slots, said second end of said strap having a fastening means thereon such that said second end of said strap may be run through the other of said slots and fastened to itself.

9. The video camera mounting apparatus as in claim 7, wherein said bore in said second plate is generally located adjacent to said second edge of said second plate, said bore being located generally along a longitudinal axis of said second plate intersecting said first and second edges of said second plate.

10. The video camera mounting apparatus as in claim 7, wherein said securing means of said camera mounting support apparatus comprises a screw and an extension screw, wherein said screw is insertable in said bore in said second plate and into an end of said extension screw, said extension screw being insertable into the stabilizer mounting hole.

11. A video camera mounting apparatus for mounting to a stabilizer mounting hole of a bow, said apparatus comprising:

a camera support for supporting a video camera thereon, said camera support comprising a first plate, said first plate having a top surface, a bottom surface, a first edge, a second edge, a third edge and a fourth edge, said first and second edges being opposite edges;

said camera support comprising a second plate, said second plate being fixedly coupled to an edge of said first plate, said second plate having a front surface, a back surface, a first edge and a second edge, said first and second edges being opposite edges, said first edge of said second plate being integrally coupled to said first edge of said first plate such that said front surface faces said first plate, said first and second plate having planes oriented generally perpendicular to each other;

a camera support mounting apparatus for mounting the camera support to said bow comprising:

a bore in said second plate; and a securing means for releasably securing said second plate to said bow, said securing means being inserted through said bore in said second plate for coupling to the stabilizer mounting hole; and a camera securing apparatus adapted for securing tile camera to the camera support comprising:

a pair of slots, each of said slots being in said first plate, one of said slots being located generally adjacent to one of said first and third edges of said plate, one of said slots being located generally adjacent to said first and fourth edges of said plate; and a strap for removably holding the video camera against said first plate, said strap having a first end and a second end, said first end of said strap being fixedly coupled in and about one of said slots, said second end of said strap having a fastening means thereon such that said second end of said strap may be run through the other of said slots and fastened to itself.

12. The video camera mounting apparatus as in claim 11, wherein said bore in said second plate is generally located adjacent to said second edge of said second plate, said bore being located generally along a longitudinal axis of said second plate intersecting said first and second edges of said second plate.

13. The video camera mounting apparatus as in claim 11, wherein said securing means of said camera mounting support apparatus comprises a screw and an extension screw, wherein said screw is insertable in said bore in said second plate and into an end of said extension screw, said extension screw being insertable into the stabilizer mounting hole.

* * * * *